United States Patent [19]

Halssig et al.

[11] Patent Number: 5,063,847

[45] Date of Patent: Nov. 12, 1991

[54] FUSE FOR A PROJECTILE

[75] Inventors: Andreas Halssig, Denkingen; Wolfgang Schillinger, Schiltach; Hans Breithaupt, Hornberg, all of Fed. Rep. of Germany

[73] Assignee: Gebruder Junghans GmbH, Schramberg, Fed. Rep. of Germany

[21] Appl. No.: 596,502

[22] Filed: Oct. 12, 1990

[30] Foreign Application Priority Data

Oct. 23, 1989 [DE] Fed. Rep. of Germany ..... 3935180

[51] Int. Cl.[5] ..... F42C 15/188

[52] U.S. Cl. ..... 102/271; 102/255; 102/256

[58] Field of Search ..... 102/270, 271, 232, 238, 102/254, 255, 260

[56] References Cited

U.S. PATENT DOCUMENTS

| | | | |
|---|---|---|---|
| 1,655,591 | 1/1928 | Brayton | 102/270 |
| 1,775,660 | 9/1930 | Teitscheid | 102/270 |

FOREIGN PATENT DOCUMENTS

| | | |
|---|---|---|
| 1065758 | 9/1959 | Fed. Rep. of Germany . |
| 2640782 | 9/1979 | Fed. Rep. of Germany . |
| 3107110 | 9/1982 | Fed. Rep. of Germany . |

*Primary Examiner*—David H. Brown

*Attorney, Agent, or Firm*—Burns, Doane, Swecker & Mathis

[57] ABSTRACT

A fuse for a projectile comprises a first igniter. A rotor is rotatable to bring a second igniter and a detonator into a live position in alignment with the first igniter. The second igniter and detonator are spaced apart to define a recess therebetween. A retardation charge is mounted in that recess which can be selectively brought into alignment with the first and second igniters and the detonator if delayed ignition is desired.

6 Claims, 3 Drawing Sheets

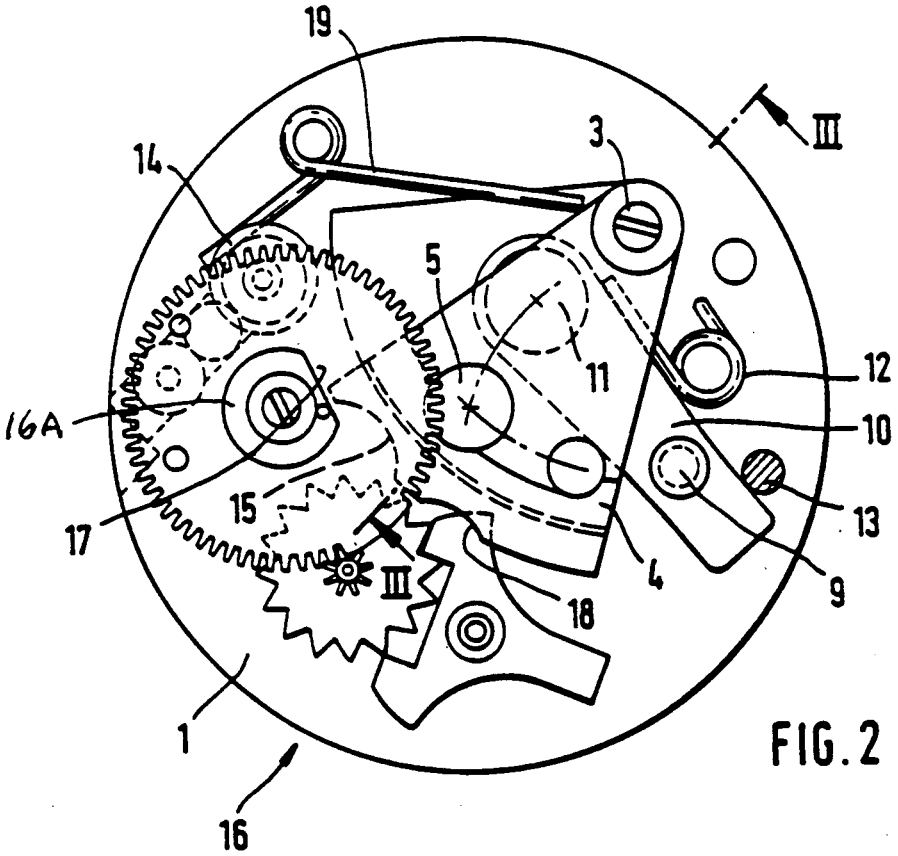
FIG. 2
FIG. 3
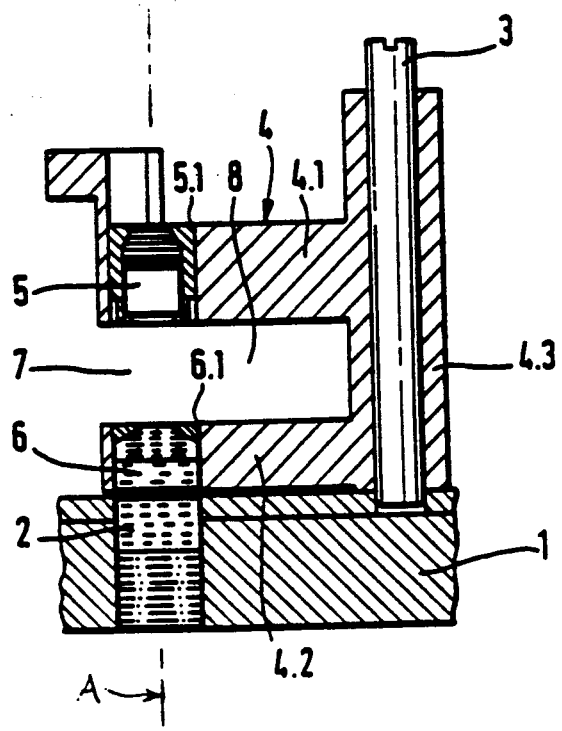

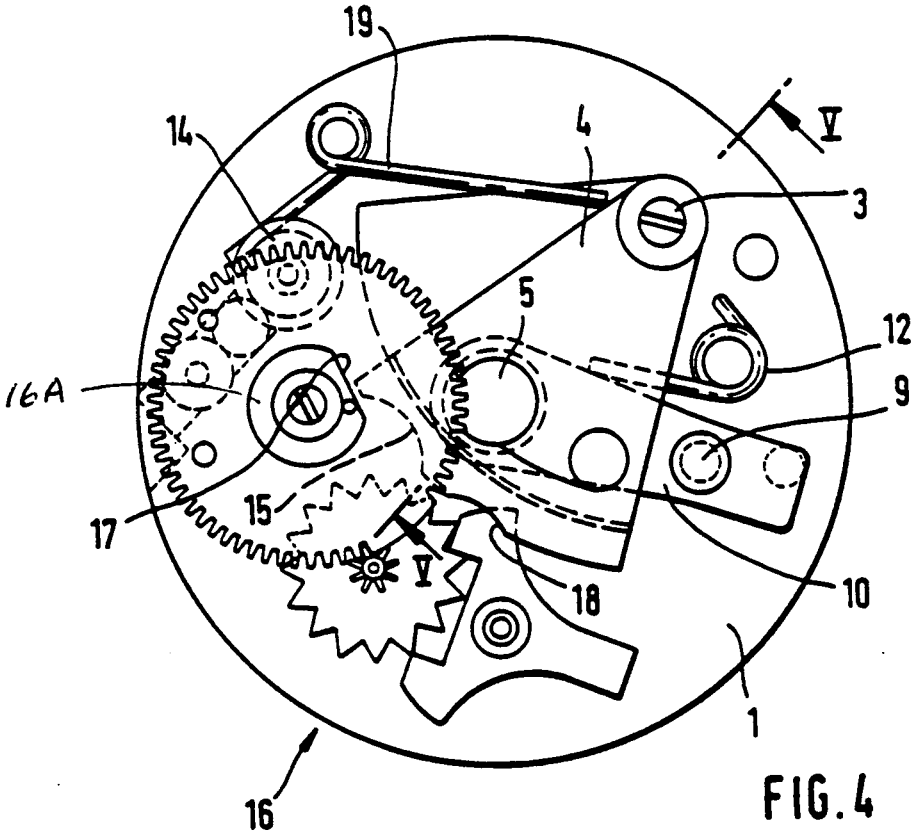
FIG. 4
FIG. 5
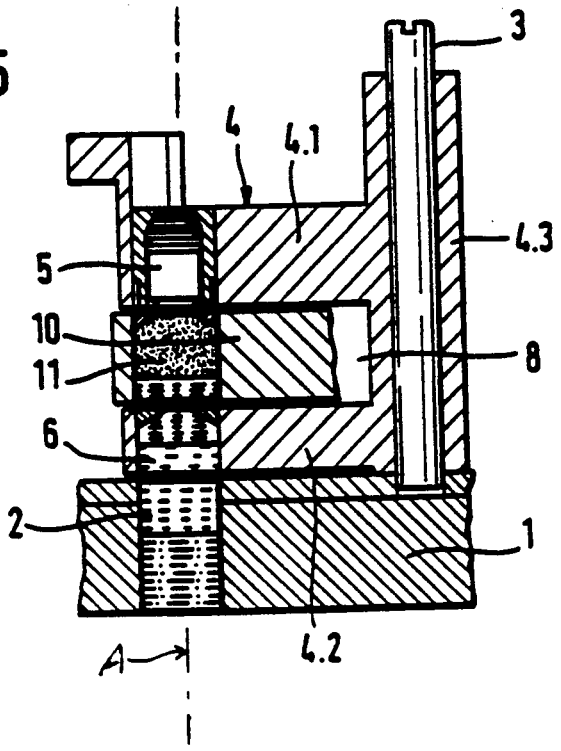

FUSE FOR A PROJECTILE

The invention concerns a projectile fuse with a safety device, comprising a first igniter, mounted in a housing on which a rotor with a second igniter is rotatingly mounted. The rotor is capable of pivoting across the housing to a position overlying the first igniter to form therewith an ignition chain. A delay action charge is selectively insertable in the ignition chain.

A safety device of that type is described in DE 26 40 782 C3 and in DE 31 07 110 A1. If the igniter itself incorporates a delaying device, then the ignition chain operates in all cases with delayed ignition. That is, it would not be possible to operate with or without delayed ignition. Thus, the versatility of such a fuse is limited.

It would be possible to provide selective ignition delay by providing two independent ignition chains, wherein only one has a delay. However, to provide two independent ignition chains would be expensive and pose additional problems relative to detonator safety.

DE-AS 10 65 758 discloses a projectile fuse wherein a free space is present between a primer and the detonator, which space may be bridged by the primer. A delaying primer may be inserted by means of a slide into the free space, if delayed ignition is desired. The configuration of this projectile fuse appears to be technically involved and complicated. On the bottom side of the rotor a groove is located, in which the primer, the delaying primer and the transfer primer may be displaced over each other, by means of separate slides under the force of springs.

It is the object of the invention to provide a projectile fuse with a safety device of the above-mentioned type, wherein the same chain of ignition may be operated selectively with or without a delay of ignition and in which the chain of ignition comprises a simple structural arrangement in a space saving manner, while assuring a safe operation.

SUMMARY OF THE INVENTION

This object is attained according to the invention by a projectile comprising a housing which carries a first igniter. A rotor is provided which is mounted for rotation about an axis of rotation. The rotor comprises first and second legs which are spaced apart in a direction parallel to that axis in order to define a recess between the legs. The first leg carries a second igniter, and the second leg carries a detonator which is aligned with the second igniter. The rotor is rotatable from a safety position to a live position. In the safety position, the second igniter and the detonator are non-aligned relative to the first igniter. In the live position of the rotor, the second igniter and the detonator are aligned with the first igniter along an ignition axis. A mechanism is provided for selectably establishing an ignition delay. That mechanism comprises a support, a portion of which carries a retardation charge. The support is arranged such that the charge-carrying portion thereof is disposed within the recess so as to be protected by the first and second legs. The support is mounted for displacement such that the charge-carrying portion thereof can be displaced within the recess between a first position in which the retardation charge is out of alignment with the ignition access, and a second position in which the retardation charge is aligned with the ignition access.

Preferably, the support is mounted for rotation about an axis of rotation which is parallel to the axis of rotation about which the rotor rotates.

Preferably, a spring is provided for displacing the support between its first and second positions. A releasable stop is provided for retaining the support in one of those positions.

Preferably, in the safety position of the rotor the retardation charge is neither in the free space nor above the ignition means.

For structural reasons, the support is preferably located on the housing.

BRIEF DESCRIPTION OF THE DRAWING

Further advantageous embodiments of the invention will become apparent from the following description of an example and the dependent claims. In the drawing:

FIG. 3 is a partial section on the line III—III of FIG. 2, with a retardation device omitted for clarity, FIG. 4 is similar to FIG. 1 wherein the safety device is in the live position with delayed ignition, and FIG. 5 a partial section on the line V—V of FIG. 4.

DETAILED DESCRIPTION OF A PREFERRED EMBODIMENT OF THE INVENTION

Figure 1:
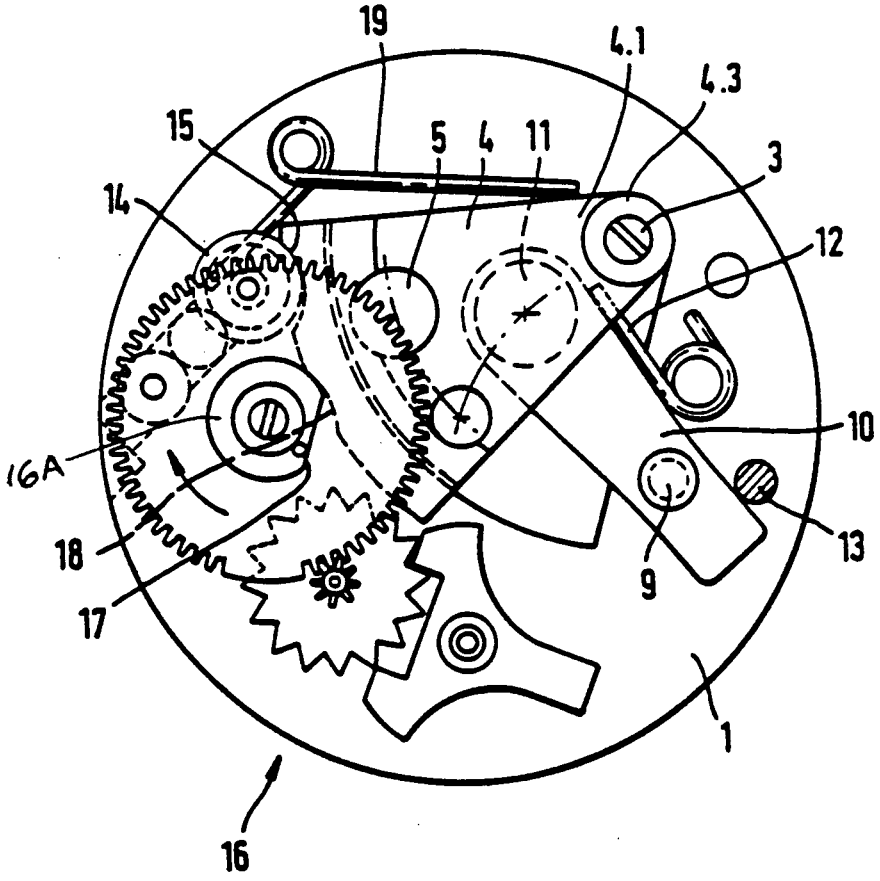
FIG. 1 is a plan view of a safety device according to the invention in the safety position, FIG. 2 in similar to FIG. 1 wherein the safety device is in the live position without delayed ignition.

In a housing (1) an ignition means (2), such as an ignition transmitter, is located (see FIG. 3). On the housing (1), by means of an axle (3) a segmented rotor (4) is mounted pivotingly. The rotor is rendered U-shaped by a recess (8) oriented transversely to the axle of rotation (3). In a first leg (4.1) of the rotor, located on top in FIG. 3, an igniter 5 is carried in a bore (5.1) oriented parallel to the rotating axle (3). In a second leg (4.2) of the rotor, located on the bottom in FIG. 3, a detonator 6 is carried in a second bore (6.1) oriented parallel to the rotor axle (3). The axle (3) is located in a remaining web or bight (4.3) of the U configuration of the rotor. Therefore, between the detonator (6) and the igniter (5) a free space (7) is present, which free space is formed by a portion of the recess (8).

On the housing (1), by means of another axle (9), a support (10) is pivotingly mounted. A retardation charge (11) is located on an end of the support which protrudes into the recess (8). The retardation charge comprises a delaying piece. The support (10) is biased by a spring (12), but is immobilized by a lock pin (13) if no ignition delay is intended (FIG. 1,2). That is, the pin (13) retains the retardation charge in an inoperational position when the rotor (4) is in either its safety position (FIG. 1) or its live position (FIG. 2).

In its safety position, the rotor (4) is blocked by a presafety element (14) which engages a depression (15) formed in the periphery of the rotor (4) and by a gear-driven blocking mechanism (16) having an element (16A) which engages a second depression (18) of the periphery of the rotor (4). The element includes a flattened segment (17) which permits release from the depression (18).

Following the release of the presafety element (14) from the depression (15) (by a conventional mechanism which is not shown) and the run-down of the escapement of the blocking mechanism (16), the flattened segment (17) releases the rotor (4) from the second depression (18). The rotor is then moved by the action of a spring (19) into its live position (from FIG. 2 to FIG. 5) wherein the igniter (5) and the detonator (6) are aligned with the igniter (2) along an ignition axis A.

If ignition without delay is intended, the support (10) remains blocked by the lock pin (13), so that the retardation charge (11) is located outside the free space (7) (FIG. 2, 3). If the igniter (5) is ignited, the ignition occurs over the free space (7) and thus over the detonator (6), which in turn ignites the ignition means (2).

If the ignition with delay is intended, the lock pin (13) is manually displaced, so that it releases the support (10). The latter then pivots under the action of the spring (12) so that the retardation charge (11) is located in the free space (7) (FIG. 4, 5) to await the eventual arrival of the igniter (5). Following the ignition of the igniter (5), the retardation charge (11) is ignited. The latter, after its delay time, ignites the detonator (6), which in turn ignites the ignition means (2).

In case delayed ignition is desired, the retardation charge (11) may be moved into the ignition chain. For example, the pin (13) could be manually displaced before firing of the projectile.

In the embodiment described, the retardation charge (11) is located, prior to its pivoting, outside the free space (7) and not over the ignition means (2).

In the afore-described embodiment the retardation charge (11) is located in a position protected by the two legs (4.1, 4.2) of the rotor.

While illustrative embodiments of the subject invention have been described and illustrated, it is obvious that various changes and modifications can be made therein without departing from the spirit of the present invention which should be limited only by the scope of the appended claims.

What is claimed:

1. A fuse for a projectile, comprising:

a housing carrying first ignition means, a rotor mounted for rotation about an axis of rotation, said rotor comprising first and second legs spaced apart in a direction parallel to said axis of rotation to define a recess therebetween, said first leg carrying second ignition means, and said second leg carrying a detonator aligned with said second ignition means, means for rotating said rotor from a safety position in which said second ignition means and said detonator are non-aligned relative to said first ignition means to a live position in which said second ignition means and said detonator are aligned with said and first ignition means along an ignition axis, and means selectively providing ignition delay comprising a support carrying a retardation charge in a portion of said support, said support arranged such that said portion thereof is disposed within said recess so as to be protected by said first and second legs, means mounting said support for displacement within said recess between a first position in which said retardation charge is out of alignment with said ignition axis, and a second position in which said retardation charge is aligned with said ignition axis, and displacing means for displacing said support between said first and second positions.

2. A fuse according to claim 1 wherein said means for rotating said rotor comprises a spring.

3. A fuse according to claim 1 wherein said displacing means comprises a spring, and a releasable stop provided for retaining said support in one of said first and second positions.

4. A fuse according to claim 1 wherein said support is normally disposed in said first position and is movable to said second position by said displacing means.

5. A fuse according to claim 1 wherein said support is mounted for rotary displacement about a second axis of rotation.

6. A fuse according to claim 5 wherein said first and second axes of rotation are parallel.

* * * * *